US005465676A

United States Patent [19]

Falcaro

[11] Patent Number: 5,465,676

[45] Date of Patent: Nov. 14, 1995

[54] BARNACLE SHIELD

[76] Inventor: Steven M. Falcaro, 1741 Braman Ave., Fort Myers, Fla. 33901

[21] Appl. No.: 409,596

[22] Filed: Mar. 24, 1995

[51] Int. Cl.[6] ..... B63B 59/00

[52] U.S. Cl. ..... 114/222; 114/45

[58] Field of Search ..... 114/45, 222, 47, 114/263, 266, 267; 405/63, 64, 68

[56] References Cited

U.S. PATENT DOCUMENTS

| | | | |
|---|---|---|---|
| 4,026,233 | 5/1977 | Cox | 114/229 |
| 4,046,094 | 9/1977 | Preiser et al. | 114/222 |
| 4,667,352 | 5/1987 | Leister | 4/498 |
| 4,693,200 | 9/1987 | Noble | 114/47 |
| 5,138,963 | 7/1992 | Eichert | 114/222 |
| 5,152,242 | 10/1992 | Bradley | 114/222 |
| 5,279,244 | 1/1994 | Perez-Collazo | 114/222 |

OTHER PUBLICATIONS

Table 10.1 from "Engineering Materials and Their Applications" 1975.

*Primary Examiner*—Edwin L. Swinehart
*Attorney, Agent, or Firm*—Frank A. Lukasik

[57] ABSTRACT

A system for discouraging and inhibiting marine growth onto a boat's underwater hull surface comprising a plurality of sections of foam filled PVC pipe tied together to form a flotation frame, an envelope of flexible, polyethylene, bubble wrap material, of a size and shape to enclose the underwater part of a boat's hull, and affixed to and supported by the flotation frame, a sprinkler hose affixed to the flotation frame for injecting fresh water for washing the boat's underwater hull, and a plurality of drain/check valves mounted in the envelope for eliminating the wash down water in the envelope.

3 Claims, 5 Drawing Sheets

BARNACLE SHIELD

BACKGROUND OF THE INVENTION

1. Field of the Invention

This invention relates generally to anti-fouling devices for boat hulls and more particularly to a floating enclosure assembly to protect against marine growth for the underbody of a boat moored in a slip.

2. Discussion of the Prior Art

It has long been established that unprotected boat hulls, when left submerged for periods of time in a body of water, are susceptible to damage through fouling by various marine organisms. A number of inventions have been devised to reduce this damage. For example, many types of permanent hull coatings have been used that act as a physical barrier between a boat's hull and the water immediately surrounding it. Such coatings, however typically do not protect the hull from the accumulation of barnacles and algae. In some cases, such coatings also reduce performance of the vessel due to the weight of the coatings. Other coatings use toxic substances to retard fouling by marine life, but significant environmental drawbacks exist with the use of such toxic coatings, and consequently, such coatings are becoming less practical.

Protectors against marine growth in the form of water impervious envelopes complementary to the underwater shape of a vessel are known. Such envelopes after being positioned around the under body of the vessel are then filled with growth inhibiting liquids which may be only fresh water or water containing anti-fouling chemicals. The problem with such envelopes is that they are difficult to maneuver around the vessel's under body and various schemes have been resorted to to ease this task but no one system has been advantageous than another and all have been burdensome.

Other devices are available that serve to protect a boat hull only while the boat is at rest, since the marine life is not able to afflict damage to the boat's hull when the boat is moving. One such device is disclosed in U.S. Pat. No. 4,026,233 to Cox which discloses a portable safety hull cover for a marine vessel which may be quickly deployed from a vessel which has sustained hull damage that destroys the water-tight integrity of the hull which could cause the vessel to flood and ultimately sink. The safety cover is a flexible, waterproof sheet of material sized and shaped for attachably conforming to the vessel bow, sides and keel, with the cover being readily connected to the bow by an attaching noose and deployed against the outside bottom of the vessel. The device has an auxiliary use to form an enclosure around the boat for cleaning the hull.

U.S. Pat. No. 4,046,094 to Preiser et al discloses a system for discouraging and inhibiting growth of the entire marine fouling community onto a ship hull while it is at rest in brackish or seawater. A pipe or pipes having nozzles distributed therealong, run the length of the keel. Fresh water is supplied to the pipe which flows out the nozzles and up along the hull to create and maintain a moving boundary layer of fresh water. An enclosure also serves to inhibit fouling. An enclosure comprising segmented, overlapping, opaque curtains hang down by weights, from the ship-deck.

U.S. Pat. No. 4,693,200 to Noble discloses apparatus for protectively enclosing and/or treating the submerged portion of a body floating on a surface of water, such as a boat hull, to prevent or reduce the growth of marine organisms on the submerged portion. The apparatus is formed of a generally rectangular frame having a depending water impervious envelope attached thereto sufficiently large to enclose the submerged portion of the floating body. Pump means are associated with the frame, mounted on the rear tubular member, with the pump adapted to pump water into the side and rear tubular means to cause the rear member to be submerged and moved pivotally downwardly about the floating front member so that the boat can be moved across the submerged rear member into the area defined by the rectangular frame.

U.S. Pat. No. 5,152,242 to Bradley discloses a protective hull enclosure for a stationary boat floating in a body of water. A flotation collar forms a first closed figure that approximates the shape of the perimeter of the hull at the surface of the water.

U.S. Pat. No. 5,279,244 to Perez-Collazo discloses an anti-fouling protector in the form of a flexible envelope complimentary to the underwater body of a vessel's hull is negatively buoyant and, when not in use, is stored on the bottom of a mooring slip.

Thus there is a need for a hull protection device that significantly reduces the fouling marine life damage of boat hulls and that is also relatively simple to install, operate, and maintain. Such a needed device should be capable of adaptation to a variety of boat hulls, environmentally acceptable, and relatively inexpensive. The present invention fulfills these needs and provides further related advantages.

SUMMARY OF THE INVENTION

The present invention is a protective hull enclosure for a stationary boat floating in a body of water, the surface of the water defining a water-line on the hull of the boat. The unit, when not in use, floats in the dock space and is tied to either rocks or piles. Floats are attached to the ends of the lines for easy retrieval. The boat is slowly taken over the floating stern section. As the stern section, with its covering, is pushed down by the bow of the boat, the wipe down bar pushes against the hull, helping to dislodge any slime or organisms that have attached. The unit can then be slid under the boat until the cleaning stern section pops up around the aft section of the boat. The lines are then tied to the boat's cleats.

DESCRIPTION OF THE PREFERRED EMBODIMENT

Figure 1:
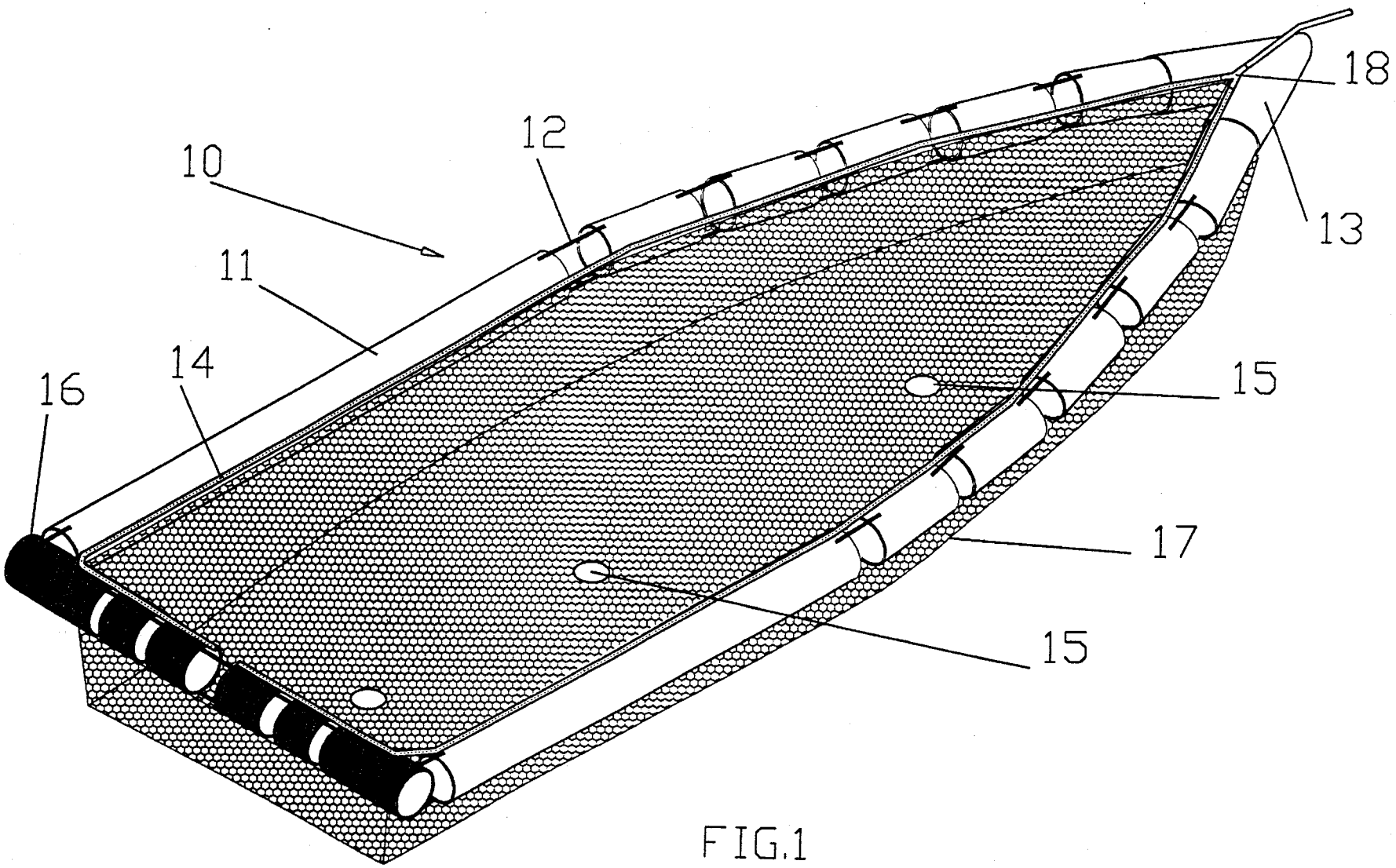
FIG. 1 is a top isometric view of a barnacle shield in accordance with the invention.
Figure 2:
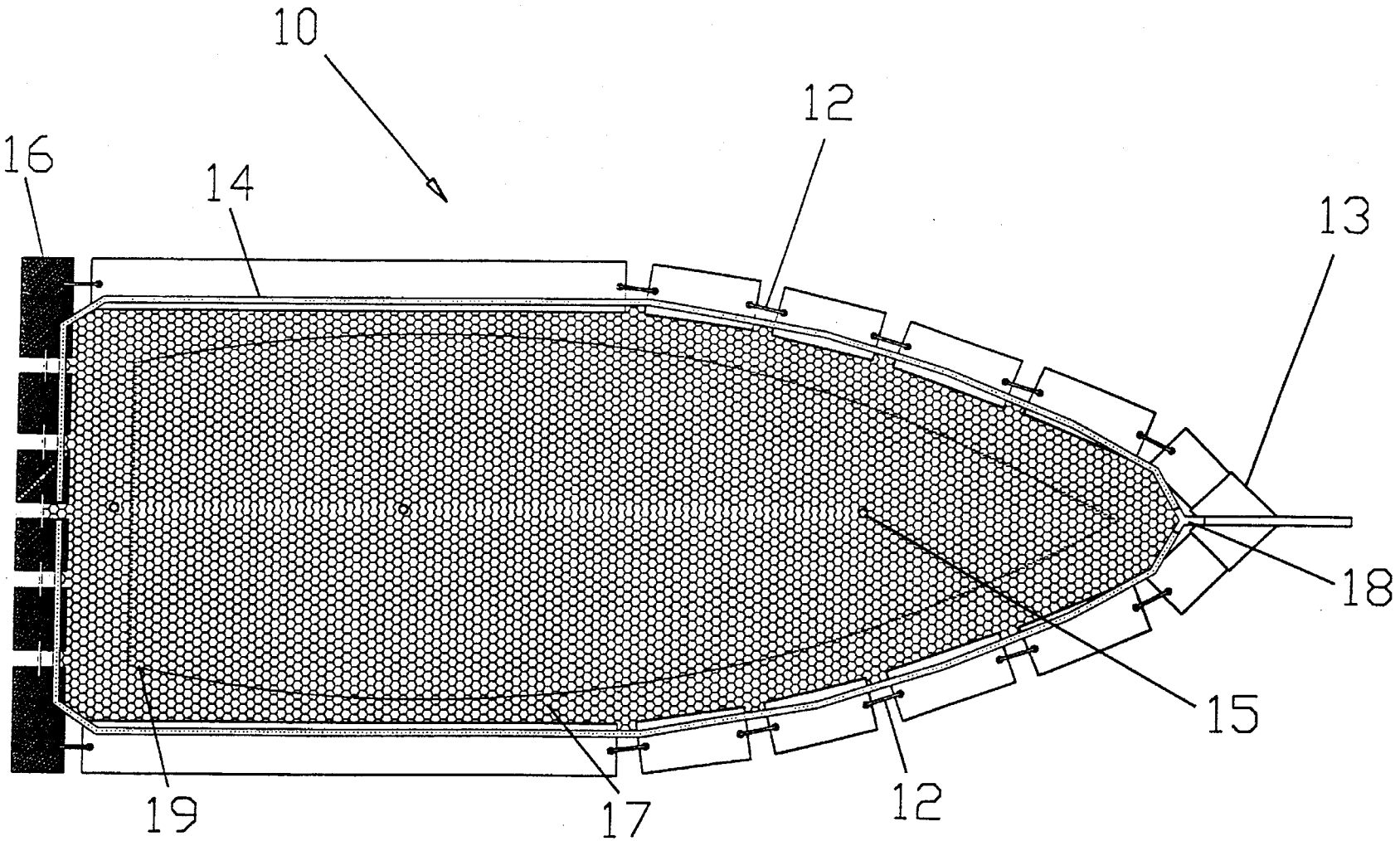
FIG. 2 is a top plan view of a barnacle shield in accordance with the invention.

Referring now to the drawings wherein like numerals refer to the same element, there is shown in FIGS. 1 and 2 generally, a barnacle shield 10, constructed from three major parts, a floating, semi-rigid frame 11 made from foam-filled PVC pipe, polyethylene bubble wrap, and fresh water wash down system 14. The frame 11 is generally made by cutting into 5 foot, 1 foot, and 6 inch lengths. The bow section 13 is constructed from two fixed lengths (depending on the beam of the boat), connected to a 90° PVC connector. Bow section 13 forms the "V" of the bow. Tie wraps 12 are used to connect adjoining lengths of frame 11.

The stern section 16 is made from smaller sections that are covered with cloth, which will act as cleaning rollers as the boat is brought in and out. The polyethylene bubble wrap 17 is cut to the appropriate size for the hull size of the boat 19. The edges of bubble wrap 17 are fixed to the inside of the frame 11 using hot-melt glue. The fresh water wash down system 14 is affixed to the inside of the frame 11 and the polyethylene bubble wrap 17 using hot-melt glue. The two sections of wash down system 14 are connected to a "Y" connector 18 which is affixed to bow section 13.

Figure 3:
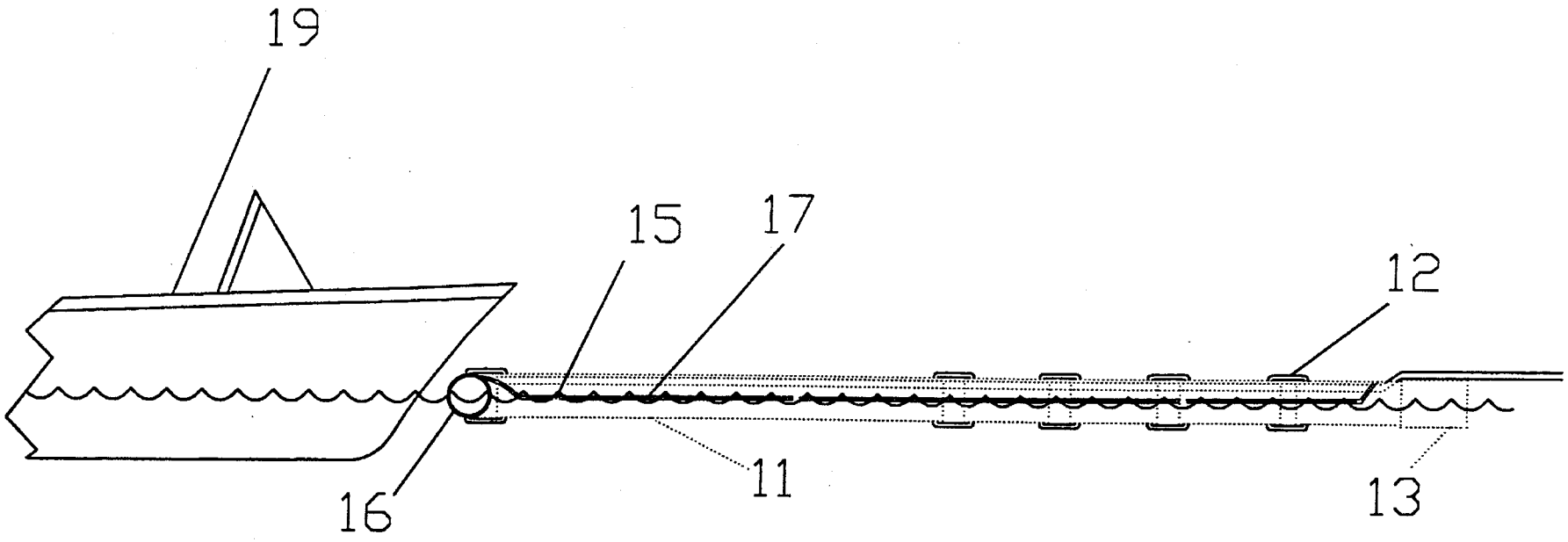
FIG. 3 is a side view of the barnacle shield, floating on top of the water, prior to a boat entering.

Check valves 15 are installed in the bottom of polyethylene bubble wrap 17 to provide for the ejection of objectionable salt water and/or the fresh water used to wash down the hull of the boat 19. The polyethylene bubble wrap 17 floats on top of the water, enclosed by the semi-rigid frame 11. FIG. 3 shows a boat 19 approaching the stern section 16, ready to be enclosed in the barnacle shield 10.

Figure 4:
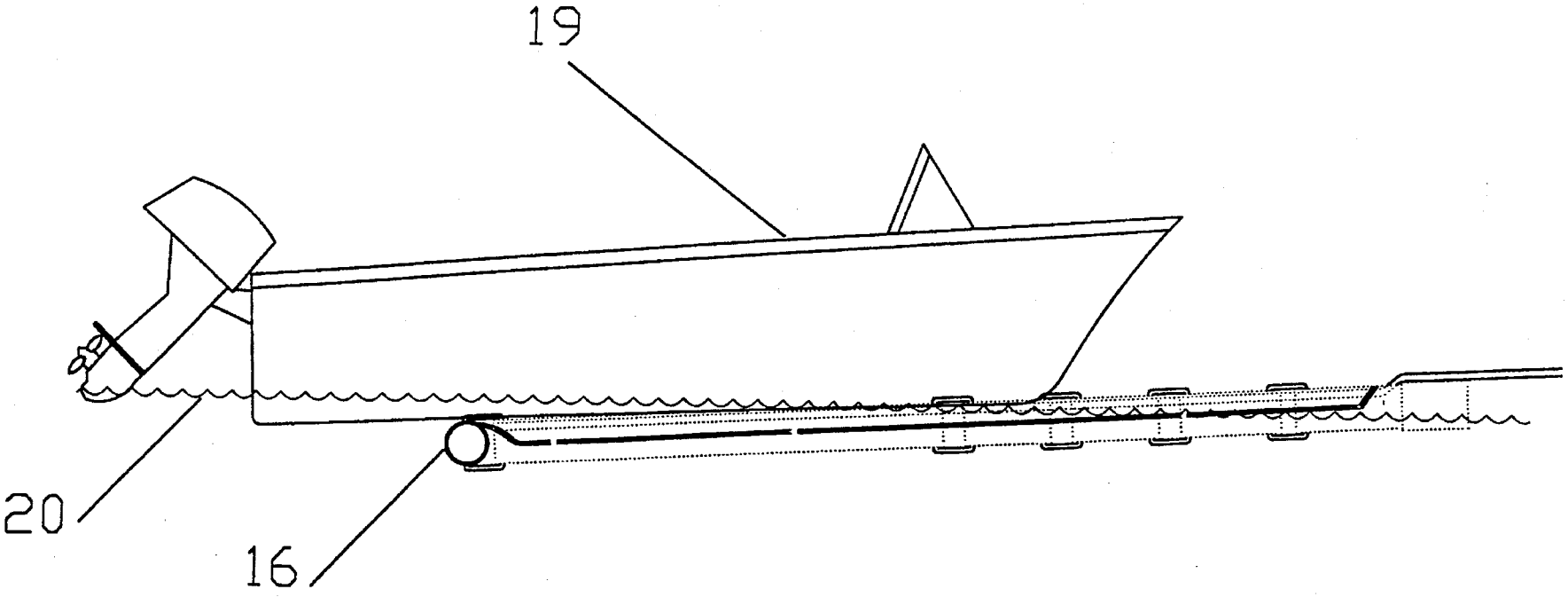
FIG. 4 is a side view of the barnacle shield with a boat entering and showing the action of a wiper wiping the hull bottom as the boat enters.
Figure 5:
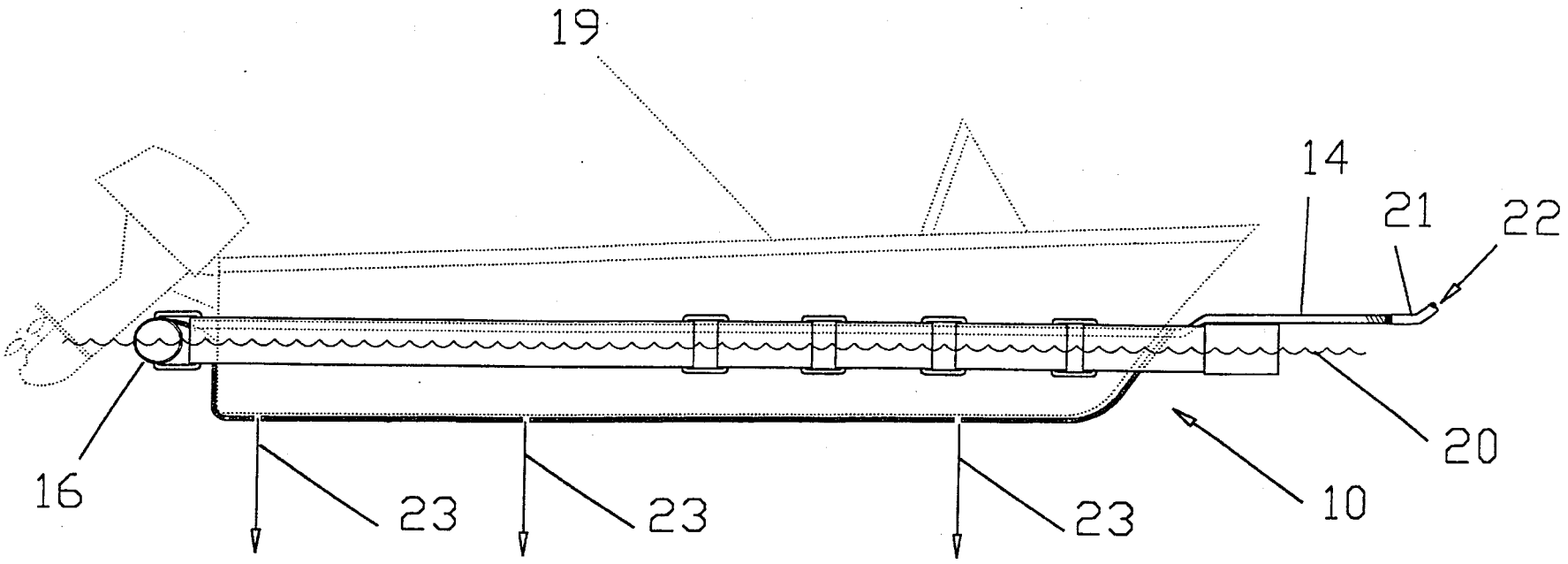
FIG. 5 is a side view of the barnacle shield with a boat in place inside the shield with fresh water being pumped in and excess water being ejected through check valves.

FIG. 4 shows the boat 19 as it passes over the stern section 16 as the boat 19 enters the interior chamber of the shield 10. As the boat 19 passes over the stern section 16, the wiping action of stern section 16 cleans the bottom of the boat 19. The level of the water is shown by the numeral 20. As the boat enters the barnacle shield 10, fresh water 22 is provided through garden hose 21 connected to sprinkler hose 14. Mooring lines (not shown) are connected to the frame 11 and tied off to pilings or rocks (not shown) to keep the barnacle shield 10 in place. As the boat 19 enters the barnacle shield 10, The fresh water 22 rinses off the sides of the hull and drops down into the envelope formed by the polyethylene bubble wrap 17, thereby diluting the salinity of the salt water and reducing the salinity required for marine growth to thrive. Sufficient fresh water 22 is admitted to totally replace the salt water. As the boat 19 enters the shield 10, the weight of the boat combines with the buoyancy of the polyethylene shield 17 to apply sufficient pressure to squeeze the water out of the polyethylene shield 17 through drain/check valves 15.

Marine life needs food, oxygen, and correct salinity of water to grow. The barnacle shield 10 of the invention is used to remove the boat 19 hull from the growing environment. The simplicity and effectiveness of the invention places the hull maintenance in the boat owner's hands. The fresh water layer on the hull surface addresses the growth problem of the portion of the marine fouling community of barnacles, tubeworms, and other organisms and the like. Fresh water inhibits their growth, by interfering with their metabolic processes. The barnacle shield enclosure 10 by excluding light addresses the growth problem of the other portion of the marine fouling community such as grasses, and algae. Thus this system addresses itself to the entire marine fouling community, to clean the hull bottom for speed and economy, eliminates the usual antifouling paint systems, and extends the ship's in-service time by reducing hauling for hull cleaning and painting.

In a preferred embodiment, the polyethylene bubble wrap 17 comprised a solar blanket manufactured by Cantor Corporation, 495 Meadow Lane, Carlstadt, N.J. 07072.

Obviously, many modifications and variations of the present invention are possible in light of the above teachings. It is therefore to be understood that within the scope of the appended claims, the invention may be practiced otherwise than as specifically described.

What is claimed is:

1. A system for discouraging and inhibiting the growth of the entire marine fouling community onto a boat's underwater hull surface comprising:

flotation means, the shape of said flotation means approximating the shape of the boat at the water line, an envelope of flexible, buoyant material, being of a size and shape complementary to the underwater part of a boat's hull from its bow to its stern, said buoyant material having a top edge and a bottom end and said buoyant material being affixed at said top edge to, and supported by, said flotation means, fresh water input means, affixed to said flotation means, for injecting fresh washdown water into said envelope for washing the boat's underwater hull surface and providing a fresh water marine growth inhibitor, and, valve means mounted in said bottom end of said buoyant material for eliminating said wash down water contained in said envelope, said buoyant material having sufficient buoyancy, when combined with the weight of the boat, to apply sufficient pressure to squeeze the water out of the envelope created by said buoyant material and through said valve means.

2. A system for discouraging and inhibiting the growth of the entire marine fouling community onto a boat's underwater surface comprising:

a foam filled PVC pipe flotation frame, approximating the shape of the boat at the water line, said frame consisting of a plurality of sections tied together to form said frame, an envelope of flexible polyethylene bubble wrap material being of a size and shape complimentary to the underwater part of a boat's hull from its bow to its stern, said material being affixed to, and supported by, said flotation frame, a fresh water sprinkler hose affixed to said flotation frame for injecting fresh washdown water into said envelope for washing the boat's underwater hull surface and providing a fresh water marine growth inhibitor, and a plurality of drain/check valves mounted in said bubble wrap material for eliminating said wash down water contained in said envelope of bubble wrap material.

3. A system for discouraging and inhibiting the growth of the entire marine fouling community onto a boat's underwater hull surface comprising:

flotation means, the shape of said flotation means approximating the shape of the boat at the water line, an envelope of polyethylene bubble wrap, being of a size and shape complimentary to the underwater part of a boat's hull from its bow to its stern, said bubble wrap having a top edge and a bottom end, and said bubble wrap being affixed at said top edge to, and is supported by, said flotation means, fresh water input means, affixed to said flotation means, for injecting fresh washdown water into said envelope for washing the boat's underwater hull surface and providing a fresh water marine growth inhibitor, said fresh water input means comprising a sprinkler hose, and, valve means mounted in said bottom end of said bubble wrap for eliminating said wash down water contained in said envelope, said valve means comprising a plurality of drain/check valves.

* * * * *